United States Patent [19]

Gauss et al.

[11] 4,108,048

[45] Aug. 22, 1978

[54] AXIAL PISTON PUMP OR PUMPING MACHINE

[75] Inventors: Wilhelm Gauss, Bildechingen; Henrious Van Logten; Arthur Krüger, both of Horb, all of Germany

[73] Assignee: Brueninghaus Hydraulik GmbH, Horb am Neckar, Germany

[21] Appl. No.: 736,268

[22] Filed: Oct. 27, 1976

[30] Foreign Application Priority Data

Oct. 31, 1975 [DE] Fed. Rep. of Germany ..... 2548730

[51] Int. Cl.[2] ..... F01B 13/04

[52] U.S. Cl. ..... 91/6.5; 91/499

[58] Field of Search ..... 91/488, 499, 506, 6.5

[56] References Cited

U.S. PATENT DOCUMENTS

| | | | |
|---|---|---|---|
| 2,300,009 | 10/1942 | Rose | 91/488 |
| 3,106,138 | 10/1963 | Thoma | 91/488 |
| 3,142,262 | 7/1964 | Firth et al. | 91/488 |
| 3,202,106 | 8/1965 | Firth et al. | 91/6.5 |
| 3,604,314 | 9/1971 | Steiner | 91/505 |
| 3,616,726 | 4/1970 | Ruger | 91/490 |
| 3,847,057 | 11/1974 | Ital | 91/6.5 |
| 3,943,827 | 3/1976 | Bocquet | 91/488 |

*Primary Examiner*—William L. Freeh

*Attorney, Agent, or Firm*—Haseltine, Lake & Waters

[57] ABSTRACT

An axial piston pump arrangement in which pistons are guided in cylinders provided in a cylinder block. The latter has channels for releasing liquid pressure within the cylinders in an area between kidney-shaped control openings that are arranged in the distributor plate. The channels are arranged in the cylinder block and feed into the cylinders at a location on the cylinder walls, which is uncovered by the pistons when the swash plate actuating the pistons, is at a substantially large inclination. These channels lead from the outside of the cylinder block to the internal walls of the cylinders, and are arranged radially in the cylinder block in the form of bores. At least two of the channels are arranged at various distances from the distributor plate in the area of the cylinder walls, so that an increasing number of channels is uncovered with increased inclination of the swash plate. The channels may have increasing diameter at increasing distance from the distributor plate.

7 Claims, 3 Drawing Figures

AXIAL PISTON PUMP OR PUMPING MACHINE

BACKGROUND OF THE INVENTION

The present invention relates to an axial piston pump or pumping machine having pistons guided in cylinders of a cylinder block and having channels for releasing the liquid pressure in the cylinders within the area between kidney-shaped control openings that are arranged in the distributor plate.

In order to obtain axial piston pumps with a low amount of vibration, fluctuation in pressure and noise, it is usual—for a specific, commonly used number of revolutions or for a specific feed pressure—to optimally adjust the arranged damping slot so that a low amount of fluctuation in pressure and of noise occur in this area. This optimization in a specific, for example, medium range in pressure and number of rotations has the disadvantage that a large amount of fluctuation in pressure arises when the swash plate or cylinder block are at full pivoting angle.

Axial piston pumps, which release the cylinder areas by bores which are axially arranged in the pistons, are known from the German patent 2 115 350 and the German laid-open document No. 2 147 045. The bores are connected with bores in the sliding blocks which receive the spherical ends of the pistons.

Such embodiments are complicated to produce, do not guarantee constant lubrication of the piston ends and transfer disturbing fluctuations in pressure, which arise in the cylinders, to the sliding blocks and the swash plate.

Accordingly, an object of the invention is to provide an axial piston pump or pumping machine which produces a low amount of disturbing fluctuation in pressure and noise, in areas of high and low pressure and rotational speeds.

Another object of the present invention is to provide a pumping arrangement of the foreqoing character which is simple in construction and may be econonmically maintained in service.

A further object of the present invention is to provide a pumping arrangement, as described, which has a substantially long operating life.

SUMMARY OF THE INVENTION

The objects of the present invention are achieved by providing that the channels are arranged in the cylinder block and feed into the cylinders in an area of the cylinder walls which the pistons uncover only when the swash plate is at a large inclination.

The present invention makes use of the fact that the swash plate is at a greater inclination with lower pressures or lower rotational speeds than with high pressures or higher rotational speeds. A greater inclination means that with a change from kidney-shaped suction openings to kidney-shaped pressure openings, the pistons are drawn a long way out of the cylinder block, thereby uncovering the channels according to the invention. As a result, fluctuations in pressure, peak pressures and also noise are removed.

In addition, the channels or bores according to the present invention can also be used with pumps which have a constant displaced volume, since with these pumps, the swash plate constantly has a relatively large inclination.

The present invention has one embodiment in which the channels lead from the outside of the cylinder block to the cylinders, so that the inner area of the cylinders are connected for a short time with the inner area of the pumps. The channels are preferably arranged radially to the cylinder block in the form of bores. These bores represent the shortest connection between the cylinders and the inner area of the pumps.

In order to gradually open the channels, it is proposed that an increasing number of channels is uncovered with increasing inclination of the swash plate. The channels can then have an increasing diameter at increasing distance from the distributor plate. A gradually opening connection can also be produced by grooves or slots leading to the channels, which are arranged in the cylinder walls. These grooves or slots are uncovered by the pistons in front of the appropriate channels. The grooves or slots may hereby have a cross-section which increases towards the channels.

While in the previous embodiments the channels are opened by the end surfaces of the pistons, this can also occur by means of annular grooves arranged on the piston periphery. These annular gooves may be connected with the inner area of the cylinder. Slots which are parallel to the axis and are arranged at the piston periphery can be provided as connection to the inner area of the cylinder. The slots parallel to the axis may hereby have a throttling cross-section.

It is not essential for opening the channels, to work additional annular grooves into the piston periphery. However, available oil compensation grooves or annular indentations, which are provided for securing the piston rod, can be used as annular grooves.

The novel features which are considered as characteristic for the invention as set forth in particular in the appended Claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
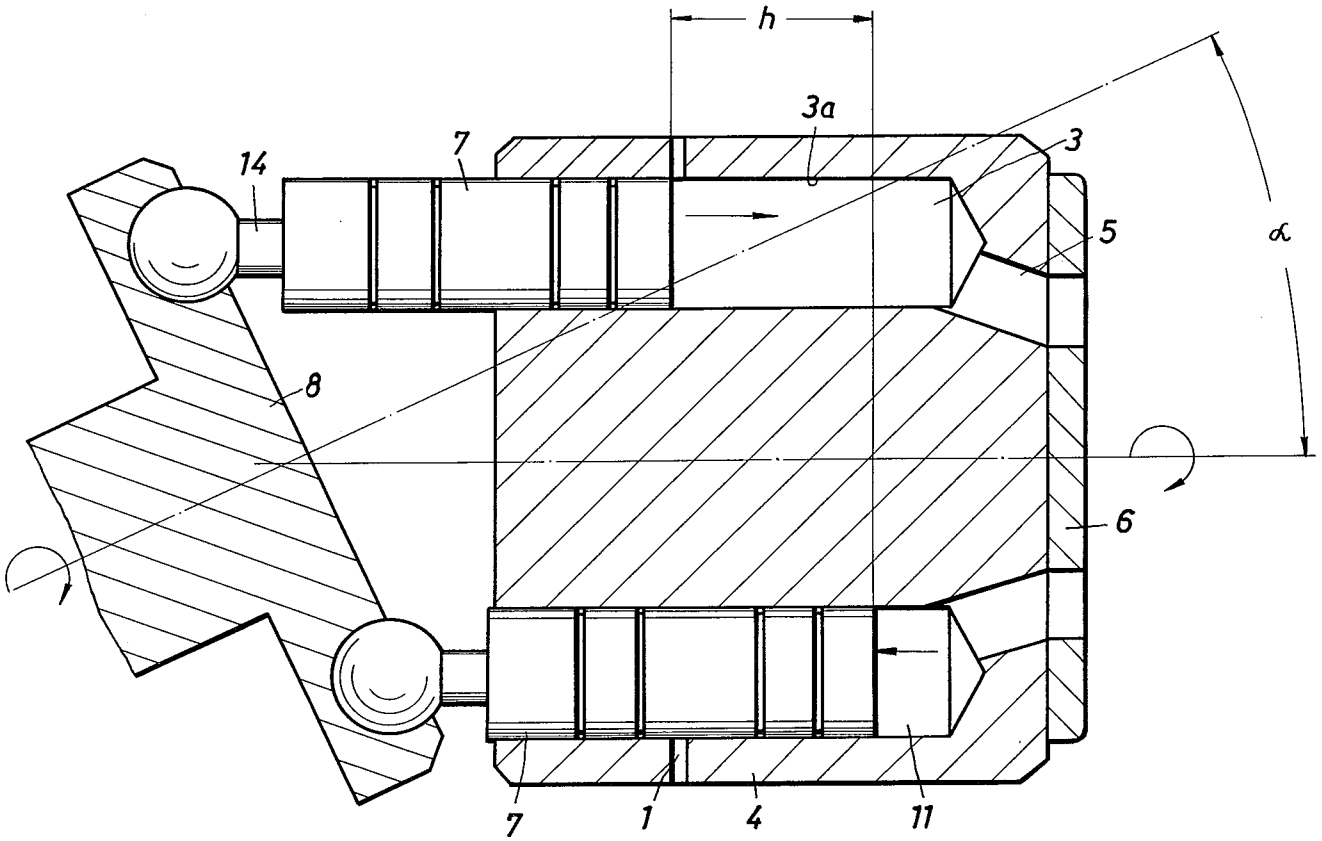
FIG. 1. shows a section through a cylinder block having a connected swash plate in a first embodiment.

Referring to the drawings, pistons 7, which are coupled to a swash plate 8, are movably positioned in the cylinders 3 of a cylinder block 4 of an axial piston pump. The inner areas 11 of the cylinders are connected with the kidney-shaped control openings of a distributor plate 6 and a bore 1, which is radially arranged in the cylinder block 4 and feeds into the cylinder 3. The bore 1 connects the inner area of the pump with the inner area 11 of the cylinder and is positioned so far away from the distributor plate 6 that it is only uncovered by the piston 7 or by its front surface when the piston is in the bottom dead center or in an area of the bottom dead center when the swash plate is at a large inclination, and the piston 7 is thereby drawn out by a large distance. On the other hand, with a low pivoting angle or a low inclination of the swash plates in relation to the cylinder block, the bores 1 remain closed, as the pistons 7 reach the bottom dead center prematurely and are thus not drawn so far out of the cylinders 3.

To increase the area in which the bore 1 is effective, slots 2, which run parallel to the cylinder axis and open with increasing cross-section to the bore 1 (FIG. 2), can be arranged in the cylinder walls 3*a*. Two or more bores can be arranged one above the other instead of slots 2, so that, similar to slot 2, the cross-section of the connection leading to the inner area of the pump increases constantly the further the piston is drawn out of the cylinder or the lower the dead center lies.

Figure 2:
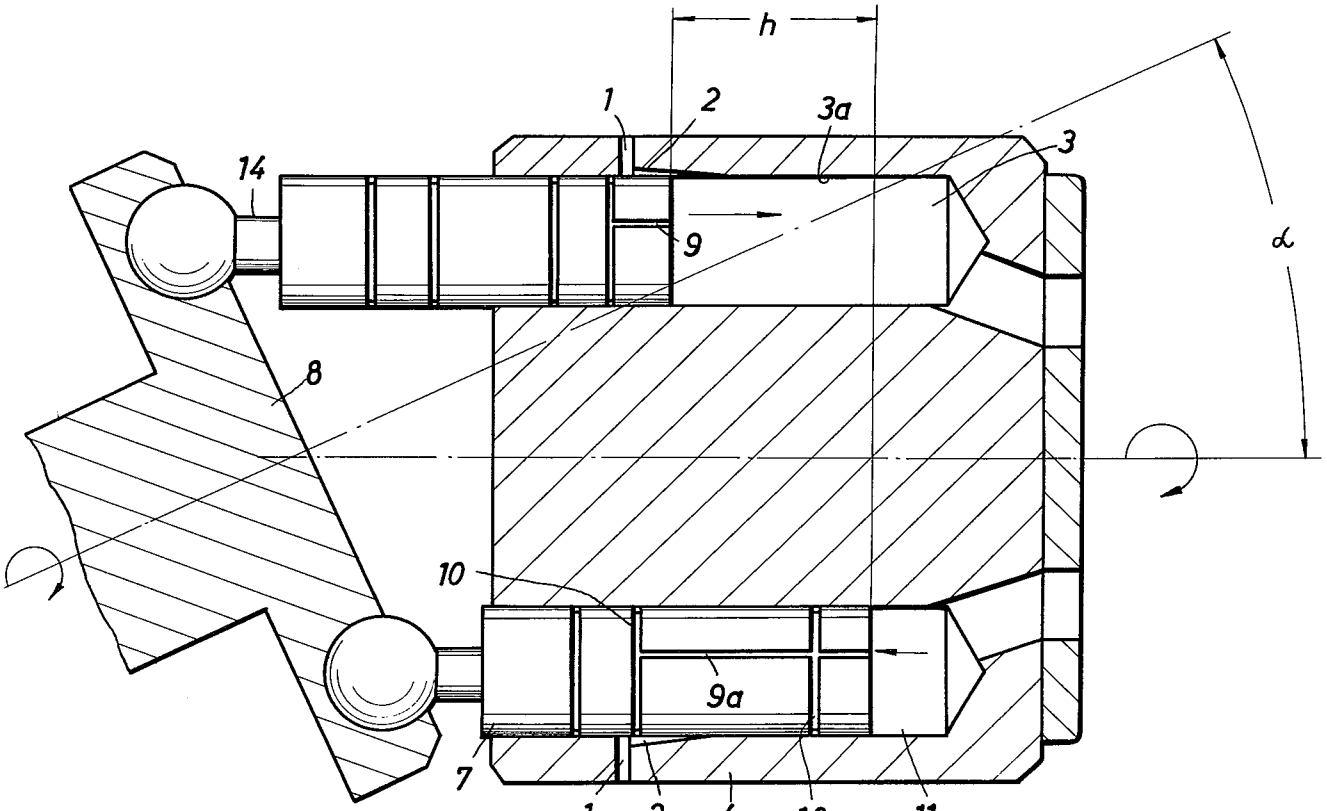
FIG. 2. shows a section corresponding to FIG. 1 in a second embodiment.

In further embodiments, the bores 1 or the slots 2 can be opened by means of annular grooves 10, 13 arranged on the piston periphery instead of by the front surface of the piston. The annular grooves 10, 13 are connected with the inner area 11 of the cylinder by slots 9, 12 which are arranged parallel to the axis in the surface of the piston skirt. Conventional oil compensation grooves 10 or wide annular indentations 13, by means of which the spherical heads of the piston rods 14 in the pistons are held, can be used as annular grooves. By arranging such annular grooves which are connected with the inner area of the cylinder, the inner area of the cylinder can also be released in the area in which the piston 7 is in the bottom dead center or in an area of the bottom dead center. It is shown in FIG. 2 how the inner area 11 of the cylinder is connected with the bore 1 in the upper dead center of the piston by means of slot 9*a*, annular groove 10 and slot 2. The slots 9, 9*a* may have a throttling cross-section whereby various strong throttlings can be achieved with the two dead centers.

Figure 3:
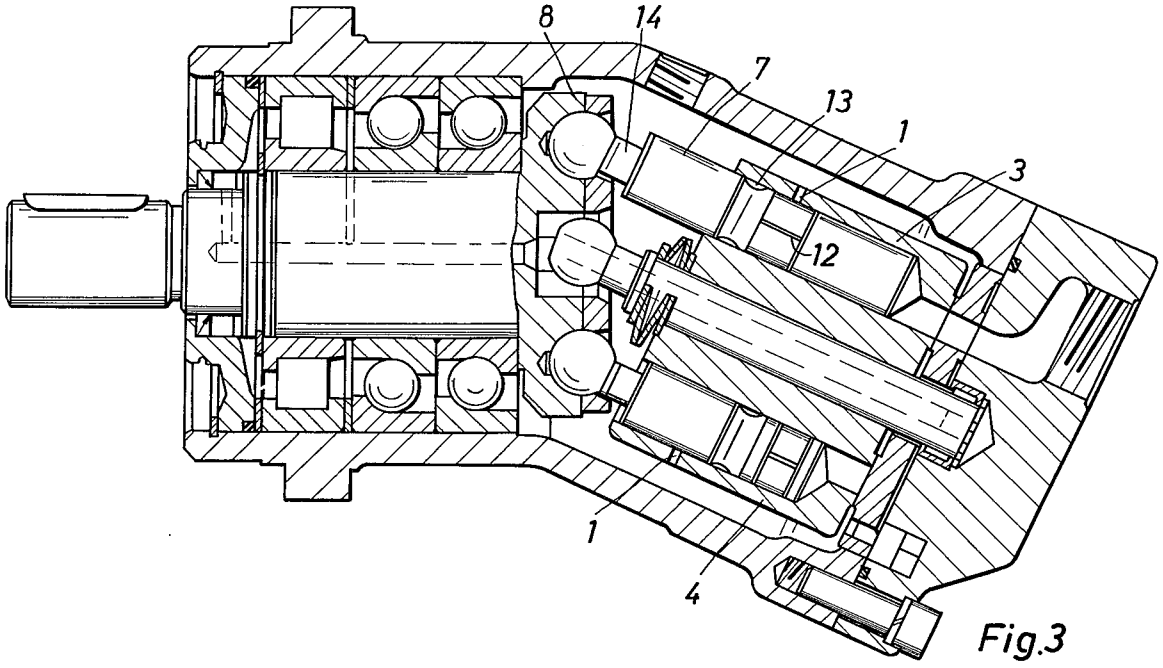
FIG. 3 shows a third embodiment arranged in a pump with constant displaced volume.

The teachings according to the invenion can not only be used with movable axial piston pumps or pumping machines but also with non-movable ones, as can be seen in FIG. 3.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following Claims.

What is claimed is:

1. An axial piston pump apparatus defined by a cylinder block with clinders; a distributor plate with kidney-shaped control openings for distributing flow to said cylinders; pistons guided in said cylinders; said cylinder block having channels for releasing liquid pressure in the cylinders within an area between said kidney-shaped control openings; wherein: said channels are arranged in said cylinder block and feed into said cylinders in an area of the cylinder walls; a swash plate connected to said pistons for actuating said pistons in said cylinders, said channels being uncovered by said pistons, and at least two of said channels are arranged at varying distances from said distributor plate in an area of the cylinder walls so that an increasing number of said channels are uncovered by said pistons extend out of said cylinders in response to increased inclination of said swash plate.

2. An axial piston pump as defined in claim 1 wherein said channels have increasing diameter at increasing distance from said distributor plate.

3. An axial piston pump as defined in claim 1 including grooves in the cylinder walls and communicating with said channels, said grooves being uncovered by said pistons in front of the respective channels.

4. An axial piston pump as defined in claim 3 wherein said grooves have an increasing cross-section in direction towards said channels.

5. An axial piston pump as defined in claim 1 wherein said pistons have annular grooves on the periphery thereof, said channels being uncovered by said annular grooves, said annular grooves being connected with the inner area of the cylinders.

6. An axial pump as defined in claim 5 wherein said pistons have slots arranged parallel to the axis of said pistons, said slots being arranged on the periphery of said pistons, said annular grooves being connected with the inner area of said cylinders by means of said slots.

7. An axial pump as defined in claim 6 wherein said slots are parallel to said axes and have a throttling cross-section.

* * * * *